US005449122A

United States Patent [19]

Berger et al.

[11] Patent Number: 5,449,122

[45] Date of Patent: Sep. 12, 1995

[54] EXTENDED OUTER RING FOR REFINER PLATE

[75] Inventors: Thomas H. Berger, Oconomowoc; Gregory A. Garasimowicz, Mukwonago, both of Wis.; Timothy J. Kelly, Lake Wylie, S.C.

[73] Assignee: Beloit Technologies, Inc., Wilmington, Del.

[21] Appl. No.: 305,121

[22] Filed: Sep. 13, 1994

[51] Int. Cl.[6] ..... B02C 7/12

[52] U.S. Cl. ..... 241/261.2; 241/298

[58] Field of Search ..... 241/261.2, 261.3, 296, 241/297, 298

[56] References Cited

U.S. PATENT DOCUMENTS 4,253,613 3/1981 Reinhall ..... 241/261.2 X 4,610,400 9/1986 Sjöbom ..... 241/261.2

FOREIGN PATENT DOCUMENTS 7407594 12/1974 Netherlands ..... 241/261.2

*Primary Examiner*—Timothy V. Eley

*Attorney, Agent, or Firm*—Dirk J. Veneman; Raymond W. Campbell

[57] ABSTRACT

A disk refiner for producing paper pulp has two counter-rotating rotors to which are mounted refining disks which spin with respect to one another to refine a stream of suspended pulp. Each disk has an outer disk ring with a plurality of radially extending refiner bars. The outer disk ring is substantially annular. A fastener extends into a threaded mounting hole in the outer disk ring to connect it to a rotor support. An inner disk ring has a plurality of protruding refiner bars which extend radially toward the outer ring. A mounting tab extends from the inner disk ring refiner bars beneath the outer disk ring. Fasteners extend through mounting holes in the mounting tab to connect the inner disk ring to the support. The fastener is covered by the outer disk ring and substantially protected from erosion thereby. The outer disk ring can be removed for servicing without disconnecting the inner ring, yet while in operation the fasteners which connect the inner disk ring are protected against contact with the erosive flow of pulp through the refiner.

10 Claims, 3 Drawing Sheets

EXTENDED OUTER RING FOR REFINER PLATE

FIELD OF THE INVENTION

This invention relates to refiners which treat paper pulp fibers in general, and to disk refiners in particular.

BACKGROUND OF THE INVENTION

During the production of fibers for papermaking, wood or other fiber source is ground into chips or mechanically treated such that the chips may be broken down further and refined into individual fibers.

Disk refiners are used with either high consistency stock containing eighteen to sixty percent fiber by weight or with low consistency pulp of two to five percent fiber dry weight. In high consistency applications the disk refiner acts to break down clumps of fibers into individual fibers. In low consistency applications the disk action is used to increase the freeness or bonding capability of the individual fibers. A refiner disk consists of a disk-shaped steel or steel-alloy casting which has a multiplicity of generally radially extending bars integrally cast with the surface of the disk. A first refiner disk is mounted on a rotor for rotation and another disk is held opposed to the first refiner disk, either by rigid mounting or by mounting on an opposite rotating rotor. The refiner disks, as they move past each other, separate and refine the wood pulp as it passes between the opposed disks.

Typically, each disk is comprised of a number of radially outwardly positioned rings which are independently bolted to the rotor and to the non-rotating surface. A disk refiner is typically only one station in a capital-intensive processing stream. To maximize productivity of the papermaking system, downtime of the refiner must be minimized. Bolting the disk sectors through the refining bar faces to the support surfaces provides ready access to the fasteners with minimal disassembly of the refiner. Due to the extensive wear on the refining bars, the rings must be removed at regular intervals and repaired or replaced. Because of the different configurations and positions of the refiner bars on inner and outer rings, the rings do not wear at equal rates. For maximum usage, one set of inner rings may remain in place while several sets of outer rings are removed. With the long-term exposure of the inner rings to wear, the heads of the bolts which hold the inner rings in place are eroded, making the eventual removal of the inner rings difficult.

What is needed is a refiner disk construction which prevents the erosion of inner disk ring bolt heads.

SUMMARY OF THE INVENTION

A disk refiner for producing paper pulp has a rotating and a fixed support to which are mounted refining disks which turn with respect to one another to refine a stream of suspended pulp. Each disk has an outer disk ring with a plurality of radially extending refiner bars. The outer disk ring is substantially annular, with an inner radius. A fastener extends into a threaded mounting hole in the outer disk ring to connect it to a support. An inner disk ring has a plurality of protruding refiner bars which extend radially toward the outer ring inner radius. A mounting tab extends from the inner disk ring refiner bars beneath the outer disk ring. A fastener extends through a mounting hole in the mounting tab to connect the inner disk ring to the support. The fastener is covered by the outer disk ring and substantially protected from erosion thereby. The outer disk ring can be removed for servicing without disconnecting the inner ring, yet while in operation the fasteners which connect the inner disk ring are protected against contact with the erosive flow of pulp.

It is an object of the present invention to provide a multi-part refiner disk with an inner ring which is easily removed regardless of service life.

It is also an object of the present invention to provide a refiner disk assembly for effective stock refining and feed.

Further objects, features, and advantages of the invention will be apparent from the following detailed description when taken in conjunction with the accompanying drawings.

DESCRIPTION OF THE PREFERRED EMBODIMENT

Figure 1:
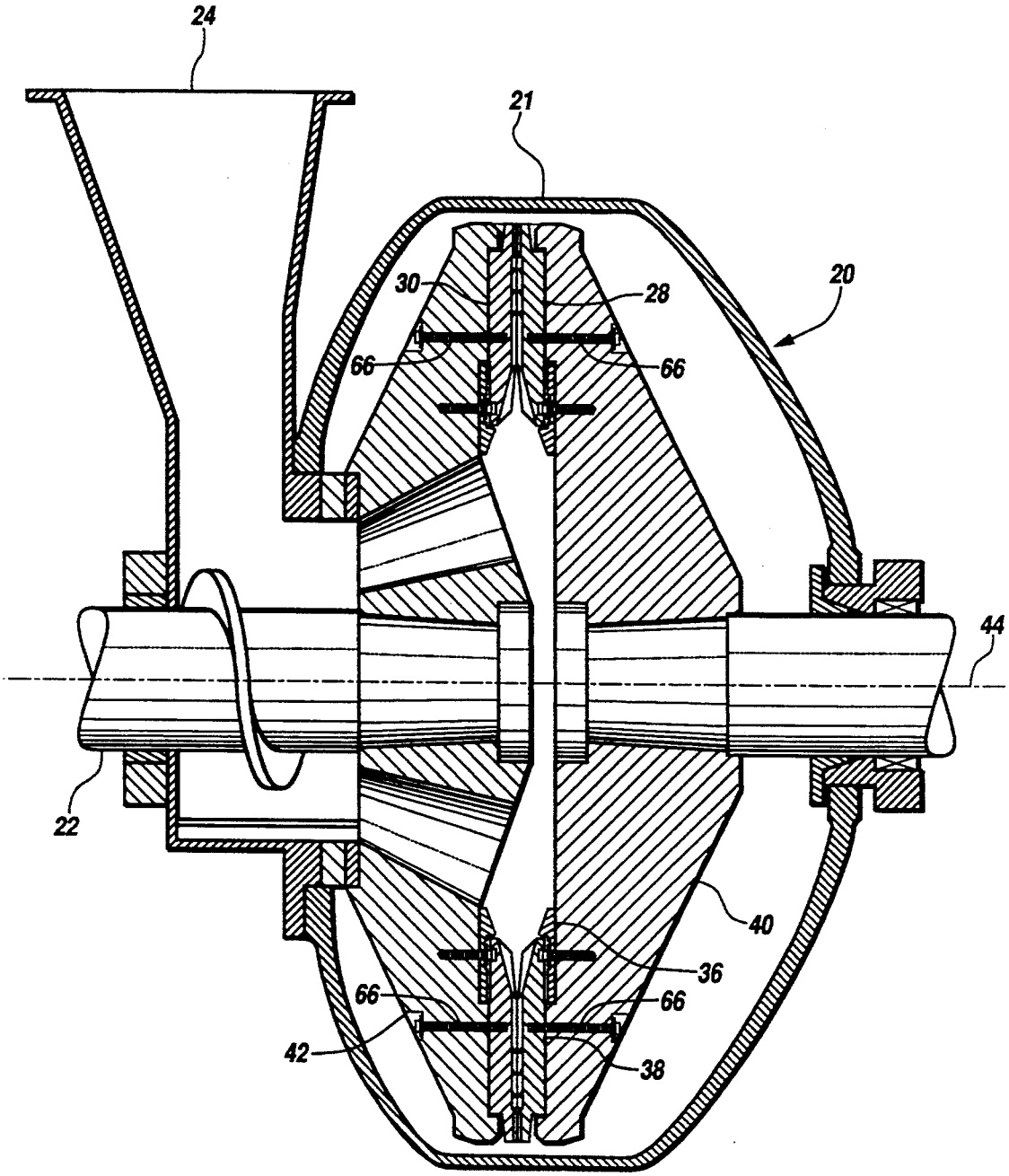
FIG. 1 is fragmentary cross-sectional view of an exemplary paper pulp disk refiner which may be used with the refiner disks of this invention.

Referring more particularly to FIGS. 1–4, wherein like numbers refer to similar parts, a typical high consistency pulp refiner 20 is shown in FIG. 1. The refiner 20 has a housing 21 with a stock inlet 24 through which the feed is introduced to an auger 22 which is mounted within the housing. The auger 22 supplies a high consistency pulp or wood chip feed consisting of eighteen to sixty percent wood chips and wood fiber suspended in liquid. The auger 22 supplies fibers and/or wood chips to a first refiner disk 28 and a second refiner disk 30 which are mounted in opposed relation within the housing 21. The refiner disks 28, 30 are generally annular members, typically comprised of a number of cast sectors 32, 34. The sectors 32, 34, form an inner disk ring 36 and an outer disk ring 38. One refiner disk 28 is mounted to a rotor 40. The second refiner disk 30 is fixed to a counter-rotating rotor 42. The refiner disks 28, 30 have refiner bars which face one another. The rotors 40, 42 and the attached refiner disks 28, 30 rotate about an axis 44 in counter-rotating relation. It should be noted that the refiner discs of this invention may also be employed in other conventional refiners, for example those refiners in which a rotor rotates with respect to a fixed support.

Figure 4:
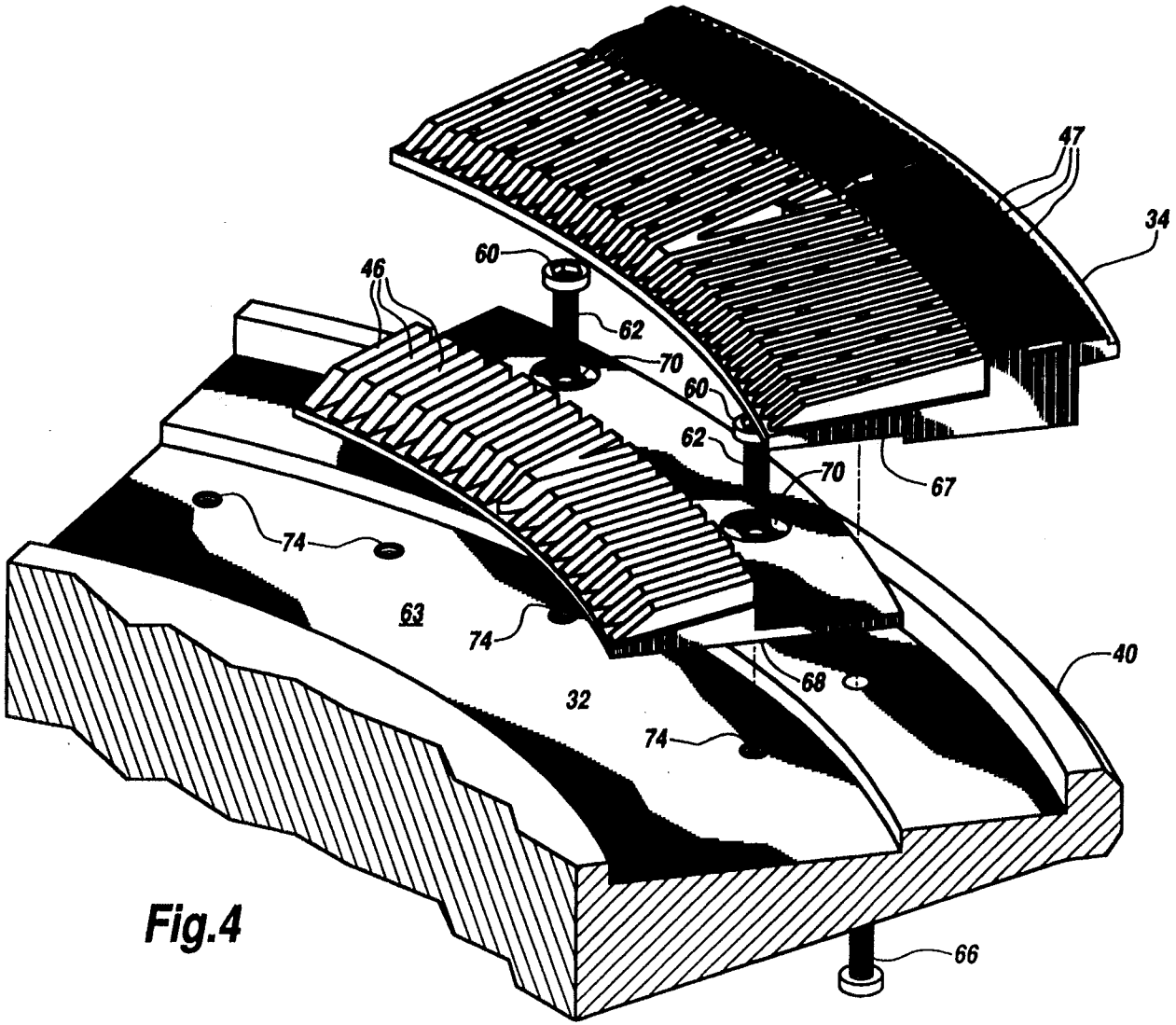
FIG. 4 is an exploded isometric view of the inner and outer disk rings of FIG. 1 positioned with respect to the refiner rotor.

As shown in FIG. 4, the refiner disk inner ring 36 and outer ring 38 have a multiplicity of radially protruding refiner bars 46, 47. An exemplary refiner bar may be one eighth of an inch wide and one quarter of an inch high, with adjacent bars spaced in parallel relation. Refiner disks are typically fourteen to forty-five inches in diameter and are rotated with respect to one another at rates of nine hundred to eighteen hundred rpm. As the disks are spun about a common axis, the refiner bars of the opposed disks pass in close proximity to one another and perform the refining action. The refiner bar pattern shown in FIG. 4 is illustrative only, actual refiner bar patterns will vary with refiner disk diameter and refiner requirements.

Figure 2:
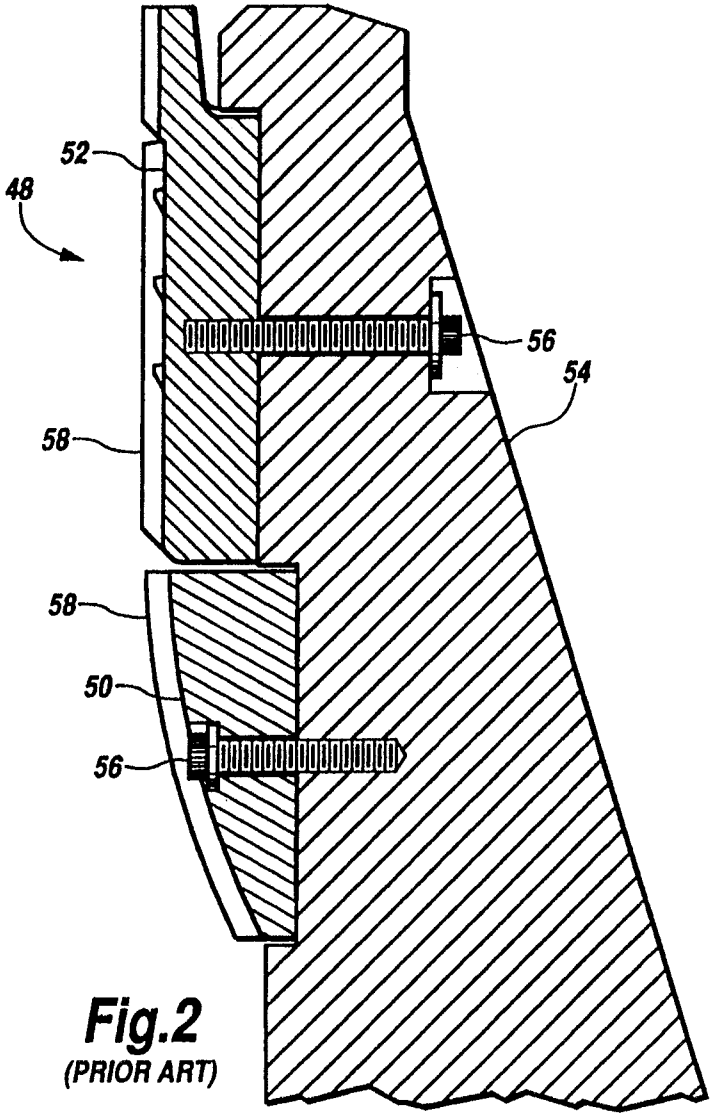
Fig.2 (PRIOR ART)
FIG. 2 is a cross-sectional view of a prior art refiner disk having an inner ring with exposed bolt heads.

A prior art refiner disk 48, shown in FIG. 2, has an inner ring 50 and an outer ring 52 which are independently bolted to a rotor 54. The prior art rings are closely radially spaced from one another, and the bolts 56 which connect the inner ring 50 to the rotor 54, although below the level of the refining bars 58, extend into the flow of stock through the refiner. The outer ring refiner bars tend to wear at a greater rate than the inner ring refiner bars, requiring that the outer ring 52 be removed more frequently than the inner bar for servicing or replacement. Over the extended time which the inner ring 50 remains fastened in place the heads of the inner ring bolts, which may be hex head, or recessed hex head, will be eroded by the flow of pulp. The bolt heads may be so eroded that it is difficult or impossible to remove the bolts in a conventional way with a wrench. If the heads are no longer accessible, costly and time-consuming alternative methods of removal must be resorted to.

The refiner disks 28, 30 of the present invention preserve the bolt heads 60 of the inner disk ring fasteners 62 by covering the fasteners 62 with portions of the outer ring 38 when the refiner 20 is in service.

As shown in FIG. 4, the rotor 40 has a circular recess 63 within which the sectors 32 of the inner ring 36 are mounted. The rotor 40 has a plurality of spot-faced mounting holes 64. Threaded outer fasteners 66 extend through the mounting holes 64 and connect the outer ring 38 to the rotor 40. Portions of the outer ring 38 extend radially inwardly to extend over the inner ring 36. These portions form a shielding member 67 which overlies the inner ring fasteners and protects them from erosion.

Figure 3:
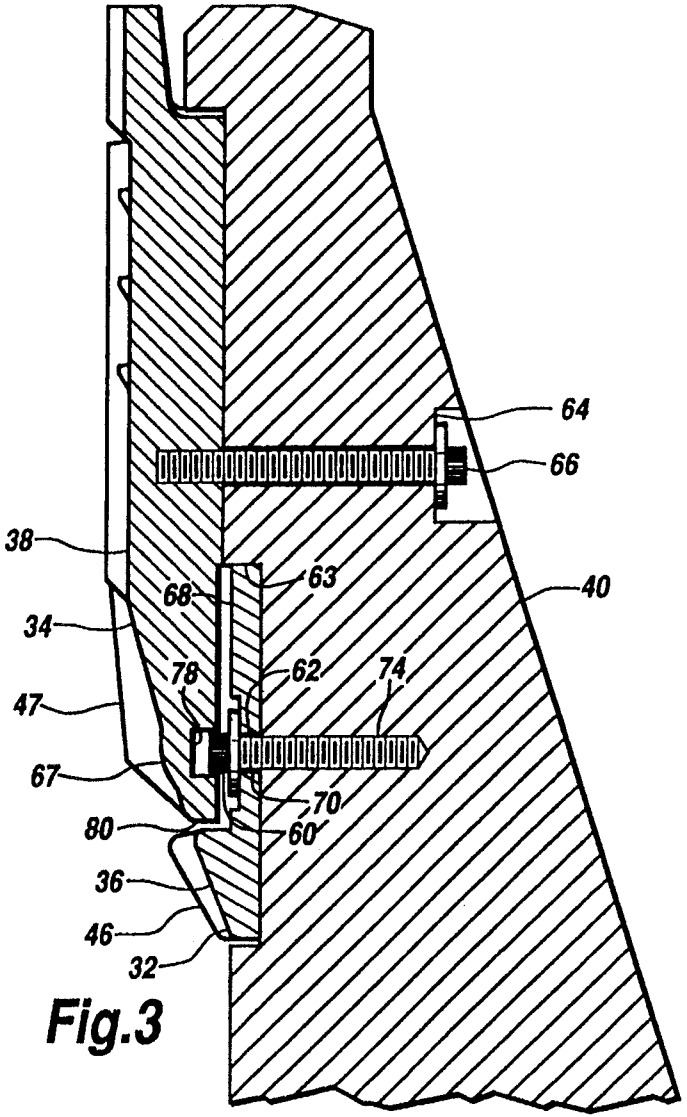
FIG. 3 is a cross-sectional view of the inner and outer rings of a refiner disk of the refiner of FIG. 1.

As shown in FIG. 3, each inner ring sector 32 has a radially outwardly extending mounting tab 68 which extends outwardly from the refiner bars 46 beneath the outer ring 38. Each mounting tab 68 has two spot-faced mounting holes 70. Fasteners 62, preferably recessed hex-head bolts, extend through the mounting holes 70 into threaded holes 74 in the recess 63 and fix the inner ring 36 to the rotor 40. The heads 60 of the fasteners 62 may protrude above the mounting tab 68, and hence circular blind holes 78 are formed in the underside of the outer ring sectors 34 which overlie the fasteners 62.

The refiner bars 46 of the inner ring 36 lead to the refiner bars 47 of the outer ring 38. Because the outer ring 38 extends over a portion of the inner ring 36, the gap 80 between the two rings is positioned closer to the axis 44 than in the prior art arrangement, where it is expected that the gap will provide reduced interference with flow, and hence improved refining and feed.

It should be noted that the refiner disk 30 which is fixed to the counter-rotating rotor 42 will likewise be comprised of inner and outer rings similar to the rotating inner ring 36 and outer ring 38.

In operation the refiner disk inner ring 36 and outer ring 38 will initially be installed at the same time. After a period of use, the outer ring refiner bars 47 will become worn and require service. The refiner 20 must then be shut down, and the outer ring 38 removed by releasing the fasteners 66. As the refiner bars 46 of the inner ring 36 wear at a reduced rate, the inner ring fasteners 62 will remain in place as a new or refurbished outer ring 38 is connected. The outer ring 38 may be replaced multiple times before it becomes necessary to replace the inner ring 36. However, because the inner ring fasteners 62 have been protected throughout their life from exposure to the corrosive effects of the high-speed flowing stock, the fasteners will be in substantially their original condition facilitating easy removal.

The refiner disks are preferably cast of white cast iron, stainless steel or other alloys combining the features of strength, wear resistance and cost-effectiveness.

It should be noted that although a high consistency refiner has been illustrated employing the refiner disks of this invention, the present invention may also be employed in a low consistency refiner. Furthermore, although a refiner with a refiner disk having only one inner ring and one outer ring has been shown, the present invention may be utilized with refiner disks having a plurality of inner rings, including a flinger nut and a breaker bar segment. In refiners having more than two disk rings, each inner ring may have a mounting tab which extends beneath the next radially outward ring for protection of the mounting fasteners.

It should also be understood that while the refiner bars of this invention are illustrated as arrayed in a certain pattern, the pattern of FIG. 4 is exemplary of refiner disk bar arrangements, and other appropriate patterns may also be employed.

It should be understood that the invention is not limited to the particular construction and arrangement of parts herein illustrated and described, but embraces such modified forms thereof as come within the scope of the following claims.

We claim:

1. A disk for a refiner for use with wood chips and wood fibers, the refiner having at least one support, the disk comprising:

an outer disk ring having a plurality of radially extending refiner bars, wherein the outer disk ring is substantially annular, with an inner radius, and wherein portions of the outer disk ring define at least one mounting hole;

a fastener which engages the outer disk ring mounting hole to connect the outer disk ring to a support;

an inner disk ring having a plurality of radially extending refiner bars which extend radially less than the outer ring inner radius, and wherein the inner disk ring has a mounting tab which extends radially outwardly from the inner disk ring refiner bars beneath the outer disk ring, and wherein the mounting tab has portions defining at least one mounting hole located beneath the outer disk ring; and a fastener which extends through the inner disk ring mounting hole to connect the inner disk ring to the support, wherein the fastener is covered by the outer disk ring and substantially protected from erosion thereby.

2. The disk of claim 1 wherein the outer disk ring is comprised of a plurality of sectors, and wherein the inner disk ring is comprised of a plurality of sectors.

3. The disk of claim 1 further comprising portions of the outer disk ring which define a blind hole above each inner disk ring fastener.

4. A refiner for wood chips and wood fibers comprising:

a housing having a stock inlet;

a rotor mounted for rotation about a central axis within the housing;

an outer disk ring having a plurality of protruding refiner bars, wherein the outer disk ring is substantially annular with an inner radius, and wherein portions of the outer disk ring define at least one mounting hole;

a fastener which engages the outer disk ring mounting hole to connect the outer disk ring to the rotor;

an inner disk ring having a plurality of protruding refiner bars which extend radially less than the outer ring inner radius, and wherein the inner disk ring has a mounting tab which extends radially outwardly from the inner disk ring refiner bars beneath the outer disk ring, and wherein the mounting tab has portions defining at least one mounting hole located beneath the outer disk ring; and a fastener which extends through the inner disk ring mounting hole to connect the inner disk ring to the rotor, wherein the fastener is covered by the outer disk ring and substantially protected from erosion thereby.

5. The refiner of claim 4 wherein portions of the rotor define a recess, and wherein the inner disk ring mounting tab is connected to the rotor within the recess to be axially beneath the outer disk ring.

6. The disk of claim 4 wherein the outer disk ring is comprised of a plurality of sectors, and wherein the inner disk ring is comprised of a plurality of sectors.

7. The disk of claim 4 further comprising portions of the outer disk ring which define a blind hole above each inner disk ring fastener.

8. In a refiner for wood chips and wood fibers having a housing with a stock inlet, a rotor mounted for rotation about a central axis within the housing, an outer disk ring and an inner disk ring connected independently by fasteners to the rotor, wherein the improvement comprises:

a shielding member which protrudes radially inwardly from the outer disk ring; and a mounting tab which extends radially outwardly from the inner disk ring beneath the shielding member of the outer disk ring, wherein the fasteners which connect the inner ring to the rotor extend through the mounting tab and are covered by the shielding member to prevent erosion of the fasteners during operation of the refiner.

9. The refiner of claim 8 wherein portions of the rotor define a recess, and wherein the inner disk ring mounting tab is connected to the rotor within the recess.

10. The disk of claim 8 further comprising portions of the outer disk ring which define a blind hole above each inner disk ring fastener.

* * * * *